US012480388B2

(12) United States Patent
Schmidt et al.

(10) Patent No.: US 12,480,388 B2
(45) Date of Patent: Nov. 25, 2025

(54) PROPELLANT CONTAINER FOR A PERFORATING GUN

(71) Applicant: The GasGun, LLC, Houston, TX (US)

(72) Inventors: Adam C. Schmidt, Bend, OR (US); Jaia D. Schmidt, Happy Valley, OR (US); Richard A. Schmidt, West Linn, OR (US)

(73) Assignee: The GasGun, LLC, Houston, TX (US)

( * ) Notice: Subject to any disclaimer, the term of this patent is extended or adjusted under 35 U.S.C. 154(b) by 510 days.

(21) Appl. No.: 17/384,947

(22) Filed: Jul. 26, 2021

(65) Prior Publication Data

US 2021/0355796 A1 Nov. 18, 2021

Related U.S. Application Data

(63) Continuation of application No. 16/292,620, filed on Mar. 5, 2019, now Pat. No. 11,073,005, which is a continuation-in-part of application No. 16/036,920, filed on Jul. 16, 2018, now Pat. No. 10,760,384, which is a continuation of application No. 14/585,956, filed on Dec. 30, 2014, now Pat. No. 10,024,145.

(51) Int. Cl.

| | |
|---|---|
| ***E21B 43/117*** | (2006.01) |
| ***E21B 43/114*** | (2006.01) |
| *E21B 43/11* | (2006.01) |
| *F42B 3/00* | (2006.01) |
| *F42B 3/02* | (2006.01) |
| *F42B 3/04* | (2006.01) |
| *F42B 3/22* | (2006.01) |
| *F42D 1/04* | (2006.01) |
| *F42D 1/045* | (2006.01) |

(52) U.S. Cl.

CPC ..... *E21B 43/117* (2013.01); *E21B 43/114* (2013.01); *E21B 43/11* (2013.01); *F42B 3/00* (2013.01); *F42B 3/02* (2013.01); *F42B 3/04* (2013.01); *F42B 3/22* (2013.01); *F42D 1/043* (2013.01); *F42D 1/045* (2013.01); *Y10T 29/49826* (2015.01)

(58) Field of Classification Search

CPC ..... E21B 43/117; E21B 43/114; E21B 43/11; F42D 1/043; F42D 1/045; F42B 3/02; F42B 3/04; F42B 3/00; F42B 3/22; Y10T 29/49826

See application file for complete search history.

(56) References Cited

U.S. PATENT DOCUMENTS

| | | | | |
|---|---|---|---|---|
| 3,422,760 | A | | 1/1969 | Mohaupt |
| 3,630,284 | A | * | 12/1971 | Fast ..... E21B 23/04 166/299 |
| 4,039,030 | A | | 8/1977 | Godfrey et al. |
| 4,081,031 | A | | 3/1978 | Mohaupt |

(Continued)

*Primary Examiner* — Yong-Suk (Philip) Ro

(74) *Attorney, Agent, or Firm* — Vorys, Sater, Seymour and Pease LLP

(57) ABSTRACT

A propellant container for a perforating gun includes a lower cap, one or more pieces of propellant positioned within the lower cap, wherein at least one of the one or more pieces of propellant defines one or more through-holes, and an upper cap matable with the lower cap to secure the one or more pieces of propellant within the lower cap. A filler material is present within interstitial spaces between the one or more pieces of propellant.

14 Claims, 8 Drawing Sheets

(56) References Cited

U.S. PATENT DOCUMENTS

| | | | | |
|---|---|---|---|---|
| 4,386,569 | A | 6/1983 | Deas | |
| 4,391,337 | A | 7/1983 | Ford et al. | |
| 4,467,878 | A * | 8/1984 | Gneiding | G05D 16/0658 137/484.4 |
| 4,491,185 | A | 1/1985 | McClure | |
| 4,548,252 | A | 10/1985 | Stowe et al. | |
| 4,633,951 | A | 1/1987 | Hill et al. | |
| 4,673,039 | A | 6/1987 | Mohaupt | |
| 4,798,244 | A | 1/1989 | Trost | |
| 5,295,545 | A | 3/1994 | Passamaneck | |
| 5,690,171 | A | 11/1997 | Winch et al. | |
| 6,082,450 | A | 7/2000 | Snider et al. | |
| 6,354,219 | B1 | 3/2002 | Pratt et al. | |
| 6,991,044 | B2 | 1/2006 | Zhang et al. | |
| 7,228,907 | B2 | 6/2007 | Schmidt et al. | |
| 7,431,075 | B2 | 10/2008 | Brooks et al. | |
| 7,621,332 | B2 | 11/2009 | Haney et al. | |
| 7,913,761 | B2 | 3/2011 | Pratt et al. | |
| 8,033,332 | B2 | 10/2011 | Haney et al. | |
| 8,336,437 | B2 | 12/2012 | Barlow et al. | |
| 8,342,094 | B2 | 1/2013 | Marya et al. | |
| 8,381,652 | B2 | 2/2013 | Glenn | |
| 2003/0155112 | A1 | 8/2003 | Tiernan et al. | |
| 2003/0155125 | A1 | 8/2003 | Tiernan et al. | |
| 2005/0109509 | A1 | 5/2005 | Snider et al. | |
| 2005/0263994 | A1 * | 12/2005 | Quioc | B60R 21/2644 280/741 |
| 2006/0185898 | A1 | 8/2006 | Seekford | |
| 2007/0084604 | A1 | 4/2007 | Haney et al. | |

* cited by examiner

PROPELLANT CONTAINER FOR A PERFORATING GUN

BACKGROUND

A hydrocarbon well (oil or gas) is typically finished using a device known as a perforating gun. This device includes a steel tube containing a set of devices, typically referred to as "shaped charges" each of which includes a charge of high explosive and a small amount of copper. The tube is lowered into the well, and the high explosive charges are detonated, fragmenting the copper and accelerating the resultant copper particles to a speed on the order of 30 Mach, so that it blasts through the wall of the steel tube, through any steel casing forming the wall of the well, and perforates the surrounding rock, thereby permitting oil or gas or both to flow into the well.

Unfortunately, the resultant perforation has some characteristics that inhibit the flow of liquid or gas into the perforation from the surrounding rock. As the copper particles push into the rock it pushes the rock immediately in its path rearward and to the side, and also heats this rock, resulting in perforation surfaces that are less permeable to the flow of liquids and gasses than would otherwise be the case.

SUMMARY OF THE DISCLOSURE

Embodiments disclosed herein include a propellant container for a perforating gun that includes a lower cap having an open end, one or more pieces of propellant housed within the lower cap, and an upper cap secured to the lower cap at the open end. In some embodiments, the upper and lower caps exhibit a cross-sectional shape selected from the group consisting of circular, polygonal, oval, ovoid, and any combination thereof. In some embodiments, the upper and lower caps are made of a material selected from the group consisting of cardboard, wood, paper, a polymer, a composite material, a metal, and any combination thereof. In some embodiments, the one or more pieces of propellant are cylindrical and exhibit a cross-sectional shape selected from the group consisting of circular, polygonal, frustoconical, and any combination thereof. In some embodiments, the propellant container further includes a filler material positioned within the lower cap. In some embodiments, the filler material comprises a material selected from the group consisting of sand, a ceramic material, a resin, bauxite, a glass material, a polymer material, a fluoropolymer material, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and any combination thereof. In some embodiments, the one or more pieces of propellant comprise at least two pieces of propellant separated by a gap filled with the filler material. In some embodiments, the one or more pieces of propellant comprise a plurality of pieces of propellant and the plurality of pieces of propellant exhibit non-uniform dimensions. In some embodiments, wherein the one or more pieces of propellant comprise a plurality of pieces of propellant non-uniformly positioned within the lower cap. In some embodiments, at least one of the one or more through-holes is defined through a sidewall of the at least one of the one or more pieces of propellant. In some embodiments, wherein a rate of combustion of each piece of propellant increases at a greater than linear rate and a surface area of each piece of propellant increases during combustion until consumed by the combustion.

Embodiments disclosed herein further include a perforating gun that includes a charge tube, one or more shaped charges supported in the charge tube, one or more containers supported in the charge tube, wherein each container comprises a lower cap having an open end, one or more pieces of propellant housed within the lower cap, and an upper cap secured to the lower cap at the open end. The perforating gun may further include a detonating cord extending to each shaped charge and each container to ignite the one or more shaped charges and the one or more pieces of propellant in each container, wherein a rate of combustion of each piece of propellant increases at a greater than linear rate and a surface area of each piece of propellant increases during combustion until consumed by the combustion. In some embodiments, the perforating gun further includes a sealed carrier that receives the charge tube for conveyance into a wellbore. In some embodiments, the perforating gun further includes a filler material positioned within the lower cap. In some embodiments, the filler material comprises a material selected from the group consisting of sand, a ceramic material, a resin, bauxite, a glass material, a polymer material, a fluoropolymer material, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and any combination thereof. In some embodiments, the one or more pieces of propellant comprise at least two pieces of propellant separated by a gap filled with the filler material.

Embodiments disclosed herein also include a propellant container for a perforating gun that includes a cap that defines an open end, and a plurality of pieces of propellant positioned and secured within the cap. In some embodiments, the one or more pieces of propellant comprise at least two pieces of propellant separated by a gap. In some embodiments, the gap is filled with a filler material.

Embodiments disclosed herein further include a propellant container for a perforating gun, comprising one or more component parts that receive and securely house a plurality of pieces of propellant within the one or more component parts.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
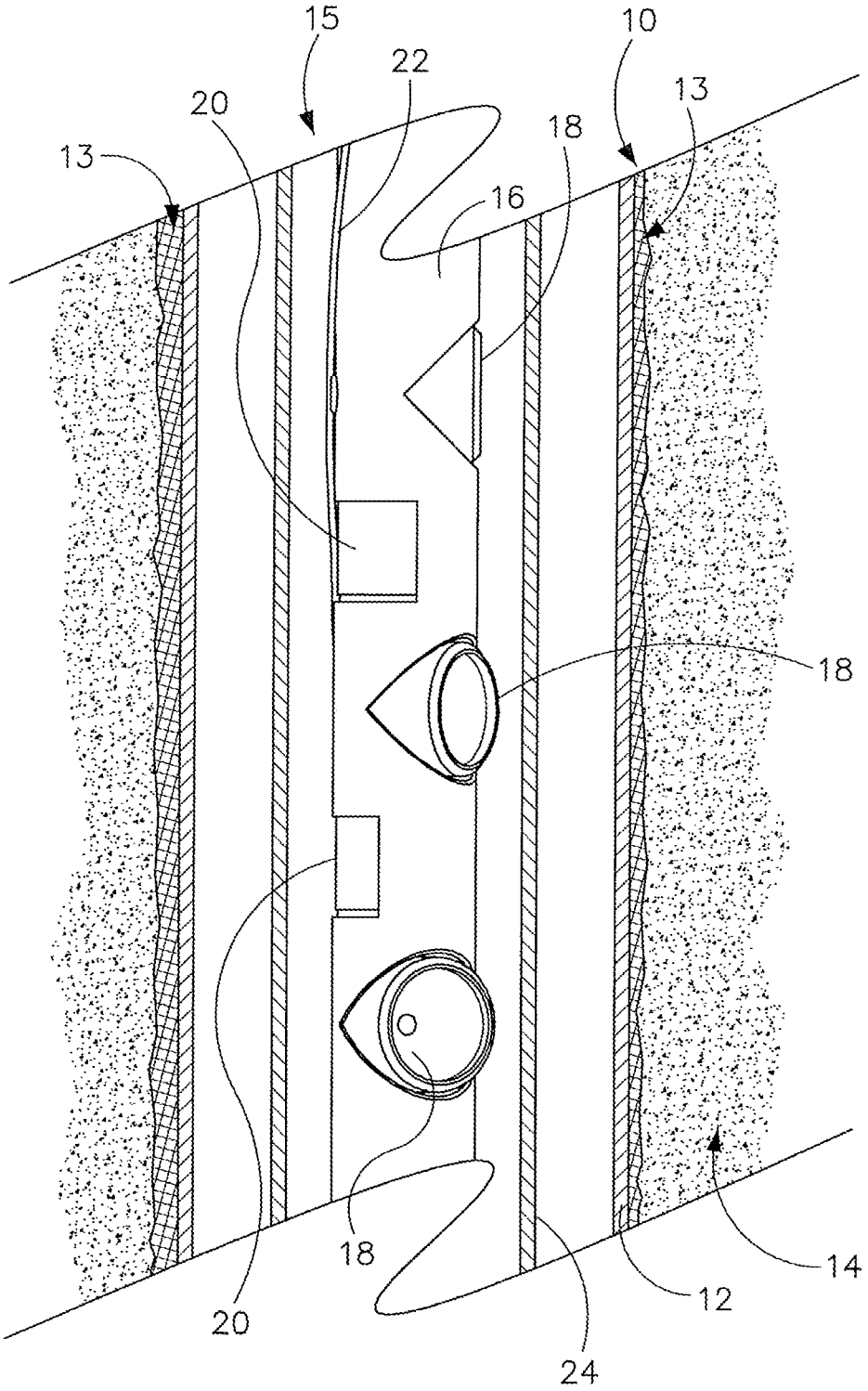
FIG. 1 is a sectional view of a portion of a hydrocarbon well having a perforation creating and finishing device, shown in a side view for ease of description.

Referring to FIG. 1, in a preferred method of creating finished perforations in the wall 10 of an oil or gas well, which is made up of steel casing 12, cement 13 and underlying rock 14, a perforating gun 15 is lowered into proximity of a portion of wall 10 to be treated. Perforating gun 15 includes a charge tube 16, which supports a number of shaped charges 18, containers 20 of propellant 38 (FIG. 7) and a detonating cord 22, all encased in a fluid-impermeable sealed steel carrier 24.

Figure 2:
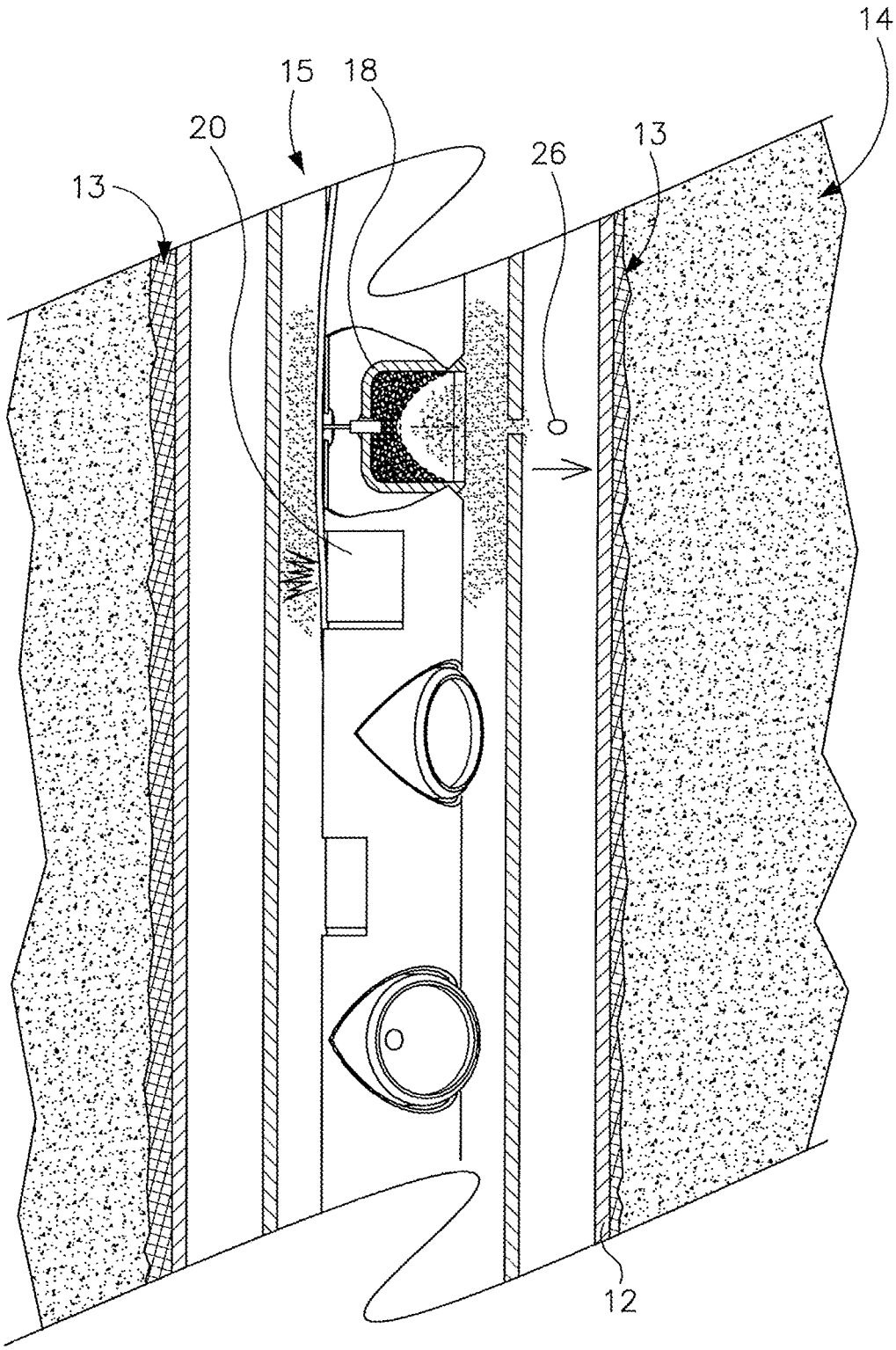
FIG. 2 shows the environment and device of FIG. 1, during detonation of the device.
Figure 3:
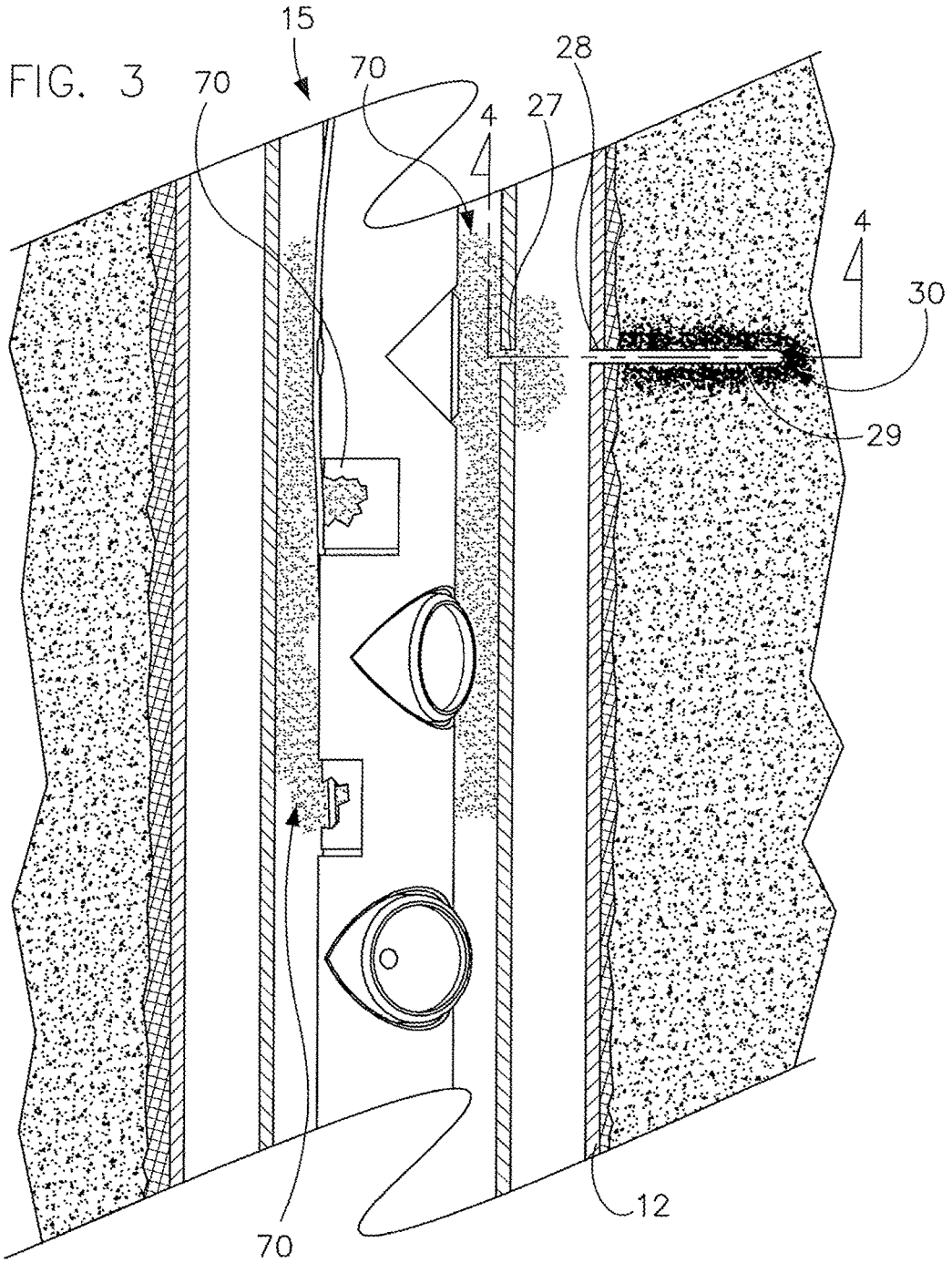
FIG. 3 shows the environment and device of FIG. 1, at a further stage of deployment, after a perforation in the well wall has been created.

Referring to FIGS. 2 and 3, the detonating cord 22 is ignited, causing the shaped charges 18 to expel particles of metal 26 (FIG. 2—shown as an ellipse for ease of presentation) at a high velocity, within ten microseconds. Travelling at approximately 30 Mach, the metal particles 26 penetrate through steel carrier 24, creating a carrier perforation 27 (FIG. 3) and into the wall 10, creating a perforation 28 (FIG. 3) through the steel casing 12, and a further perforation 29 (FIG. 3) in the rock 14, thereby facilitating the flow of hydrocarbons into the well.

The movement of the metal particles 26 into the rock creates a perforation 29, having walls 30, which have been seared and made more dense by rock 14 that has been pushed to the side or pushed toward the back of the perforation 29. Consequently, the perforation does not facilitate the flow of oil as much as might be possible. The containers 20 of propellant 38 combust over a period between 10 and 100 milliseconds, far more slowly than the action of the shaped charges 18.

In one preferred embodiment, the rate of combustion 56 of the propellant 38 increases with greater pressure, causing the combustion rate to increase at a greater than linear rate 48 as some propellant 38 combusts and the gas thereby released creates a higher pressure; however, at least one additional piece 39 of propellant 38 may not combust at an increasing rate after being ignited. Referring to FIGS. 5, 6, 7 and 8, in a few milliseconds, the combustion has spread over the surface areas of the pieces 39 of propellant 38 (FIG. 7), including the interior surface areas, created by a set of seven through-holes 40 in each piece 39 of propellant 38.

As the through-holes 40 grow in diameter, due to the combustion, the surface area of each through-hole 40 grows, just as the outer diameter of the piece 39 of propellant 38 is reduced over time. In one preferred embodiment, the pieces 39 of propellant 38 are packed together in groups, with each group including seven pieces 39 of propellant 38, and being interposed between two shaped charges.

Figure 8:
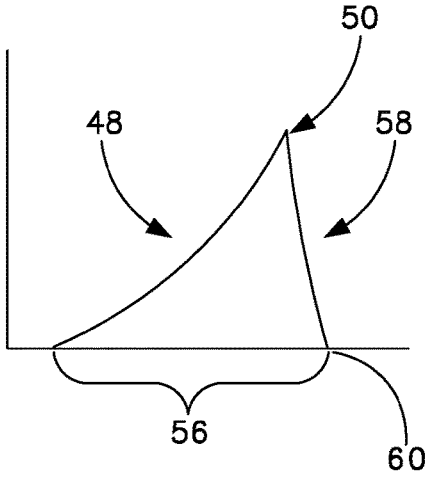
FIG. 8 is a graph of combustion rate over time of the propellant in the device of FIGS. 1-3 and 5.

Referring to FIG. 8, as the propellant collectively combusts, the combustion rate 48 of propellant 38 reaches a maximum 50 (FIG. 8), directly before the fuel is exhausted, resulting in a high maximum combustion rate 50, followed by a rapid plunge 58 to zero 60. In one preferred embodiment, the rapid decline 58 takes less than one-sixth of the blast time duration. In another preferred embodiment, the rapid decline 58 takes less than one-tenth of the blast time duration. Not only does the combustion rate increase due to through-holes 40, but also because propellant 38 combusts more rapidly under higher pressure.

As the combustion progresses, a gas 70 is produced, which increases the pressure inside carrier 24 (and very quickly, outside of carrier 24, as well). This increased pressure also causes propellant 38 to combust more rapidly, leading to the nonlinear combustion rate curve 48. In a preferred embodiment, the period during which the combustion rate plunges from the maximum 50 to zero 60 (the combustion cessation period), takes less than one-tenth of the total time period of combustion 56. For each piece 39 of propellant 38 the combustion cessation period is less than one-thirtieth of the period of combustion 56 (for the same piece 39 of propellant 38).

The hot gas 70, that is the product of the propellant combustion is pushed rapidly and forcefully out of the carrier perforations 27 with increasing speed that is proportional to the increasing pressure caused by the gas blast, and into well wall perforations 28 and 29, which are still fairly well aligned with carrier perforation 27, as the relatively massive perforating gun 15 accelerates and moves relatively slowly. In one preferred method, the pressure created by gas 70 increases until a maximum is reached before declining rapidly. Both the speed and the pressure of the gas 70 act to break apart the rock 14, and create a star pattern of fissures 72 emanating radially from perforation 29, thereby facilitating the flow of oil and gas into the well.

The through-holes 40 of propellant 38 result in a higher maximum combustion rate and a corresponding higher pressure at perforation 29, than would be otherwise the case. Surprisingly, because of the through-holes 40, the maximum pressure applied to the perforations 29 is high enough to be effective, even though large portions of steel carrier 24 are taken up by shaped charges 18, and thereby not available for stowage of propellant 38.

The propellant 38 includes its own oxidizer, and so does not need any external source of oxygen to combust. Further, propellant 38 may be either single-based (nitrocellulose), double-based (nitrocellulose and nitroglycerin), or triple-based (nitrocellulose, nitroglycerin, and nitroguanadine).

Figure 7:
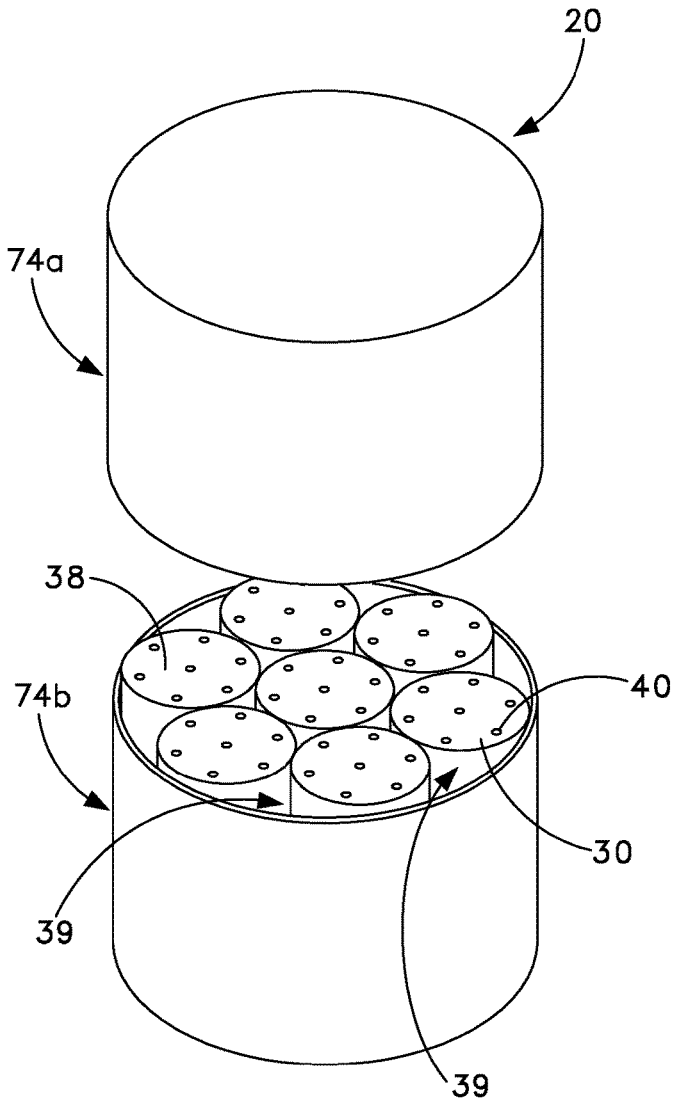
FIG. 7 is an isometric view of a cylindrical carton filled with pieces of propellant.

Referring to FIG. 7, the container 20 may be configured to securely house the pieces 39 of propellant 38. To accomplish this, the container 20 may include a first or upper cap 74*a* and a second or lower cap 74*b* matable with the upper cap 74*a*. The pieces 39 of propellant 38 may be arranged within the lower cap 74*b* and once the upper cap 74*a* is properly mated with the lower cap 74*b*, the pieces 39 of propellant 38 will be secured within the container for transport, assembly into the perforation gun 15 (FIG. 1), and subsequent downhole use as described herein. In some embodiments, as illustrated, the upper and lower caps 74*a,b* may be generally circular in shape or otherwise exhibit a circular cross-section. In such embodiments, the diameter of the lower cap 74*b* may be slightly smaller than the diameter of the upper cap 74*a* such that upper cap 74*a* may be sized to receive the lower cap 74*b*. In other embodiments, however, the cross-sectional shape of the upper and lower caps 74*a,b* may be polygonal (e.g., triangular, rectangular, etc.), oval, ovoid, or any combination thereof, without departing from the scope of the disclosure.

Mating the upper and lower caps 74*a,b* may form an interference fit between the two components that prevents inadvertent separation. In some embodiments, however, the mated engagement between the upper and lower caps 74*a,b* may be secured, such as with an adhesive or a wax, or may comprise a threaded interface. In at least one embodiment, mating the upper cap 74*a* to the lower cap 74*b* may result in the generation of a sealed interface between the two components. This may prove advantageous in preventing the ingress or migration of moisture into the interior of the container 20.

The container 20 may be made of any material rigid enough to contain and protect the pieces 39 of propellant 38. Example materials for the container include, but are not limited to, cardboard, paper, wood, a polymer (e.g., polystyrene), a composite material, metal (e.g., steel, aluminum, brass, copper, etc.), or any combination thereof.

It should be noted that while seven pieces 39 of propellant 38 are shown arranged within the lower cap 74*b*, more or less than seven pieces 39 may be employed. In at least one embodiment, for instance, a single piece 39 of propellant 38 may be contained within the container 20 for use. Moreover, while each piece 39 of propellant 38 is depicted as having seven through-holes 40 defined therethrough, some or all of the pieces 39 of propellant 38 may define more or less than seven through-holes 40, without departing from the scope of the disclosure.

Figure 9:
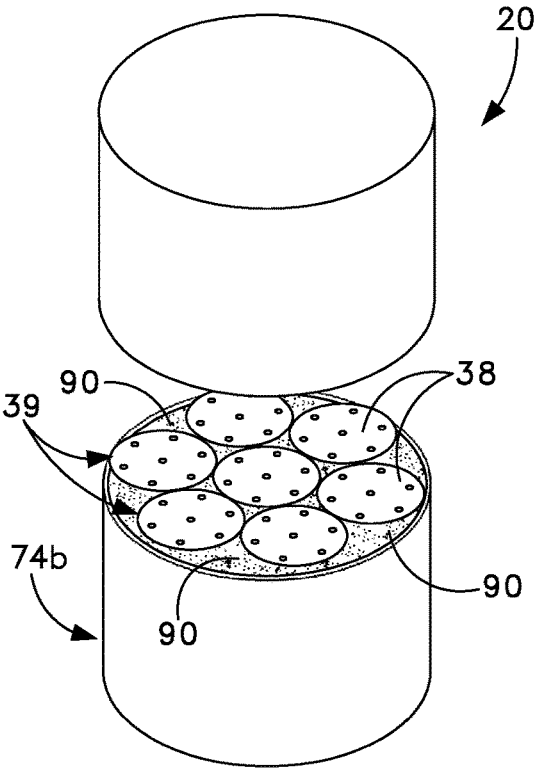
FIG. 9 is a schematic view of one embodiment of the container of FIG. 7, according to the principles of the present disclosure.

FIG. 9 is a schematic view of another embodiment of the container 20 according to the principles of the present disclosure. In the illustrated embodiment, the pieces 39 of propellant 38 are contained within the lower cap 74*b* and a filler material 90 is packed into the interstitial spaces between the adjacent pieces 39. The filler material 90 may comprise a particulate material, or a material substantially in the form of particulate, particles, grains, flakes, or a mixture thereof. The term "particulate" as used herein includes all known shapes of materials, including substantially spherical materials, fibrous materials, polygonal materials (e.g., cubic materials), and any combination or mixture thereof.

Suitable particulate materials that may be used as the filler material 90 include, but are not limited to, sand, ceramic materials, resins, bauxite, glass materials, polymer materials, Teflon® materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, or any combination thereof. Suitable composite particulates may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, or any combination thereof. The particulate size generally may range from about 2 mesh to about 400 mesh on the U.S. Sieve Series; however, in certain circumstances, other sizes may be desired and will be entirely suitable for practice of the present disclosures. In particular embodiments, preferred particulate size distribution ranges are one or more of 6/12, 8/16, 12/20, 16/30, 20/40, 30/50, 40/60, 40/70, or 50/70 mesh.

In some embodiments, the filler material 90 may be tamped and packed tightly into the lower cap 74*b* to secure the pieces 39 of propellant 38 in place. In other embodiments, however, the filler material 90 may merely be poured into the lower cap 74*b* and allowed to fill in the interstitial spaces between the pieces 39. In at least one embodiment, the filler material 90 comprises sand. Sand may prove especially advantageous since sand grains are generally angular, irregular, and of varying shapes and sizes, which allows the filler material 90 to be effectively tamped and packed tightly into the lower cap 74*b*. In some cases, sand may have the ability to be packed as tightly as a cement.

Figure 4:
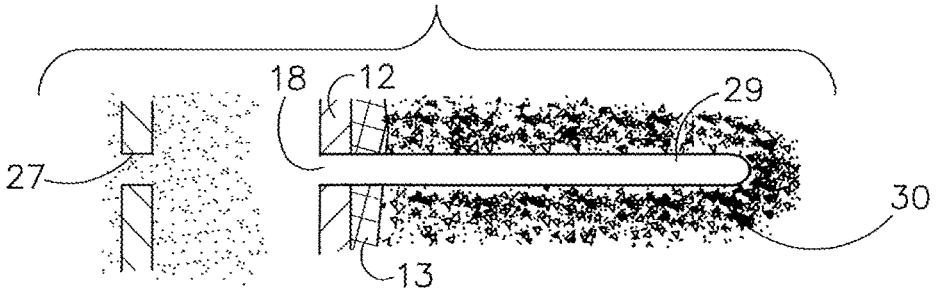
FIG. 4 is an expanded sectional detail view of the well wall perforation of FIG. 3, taken along line 4-4 of FIG. 3.
Figure 5:
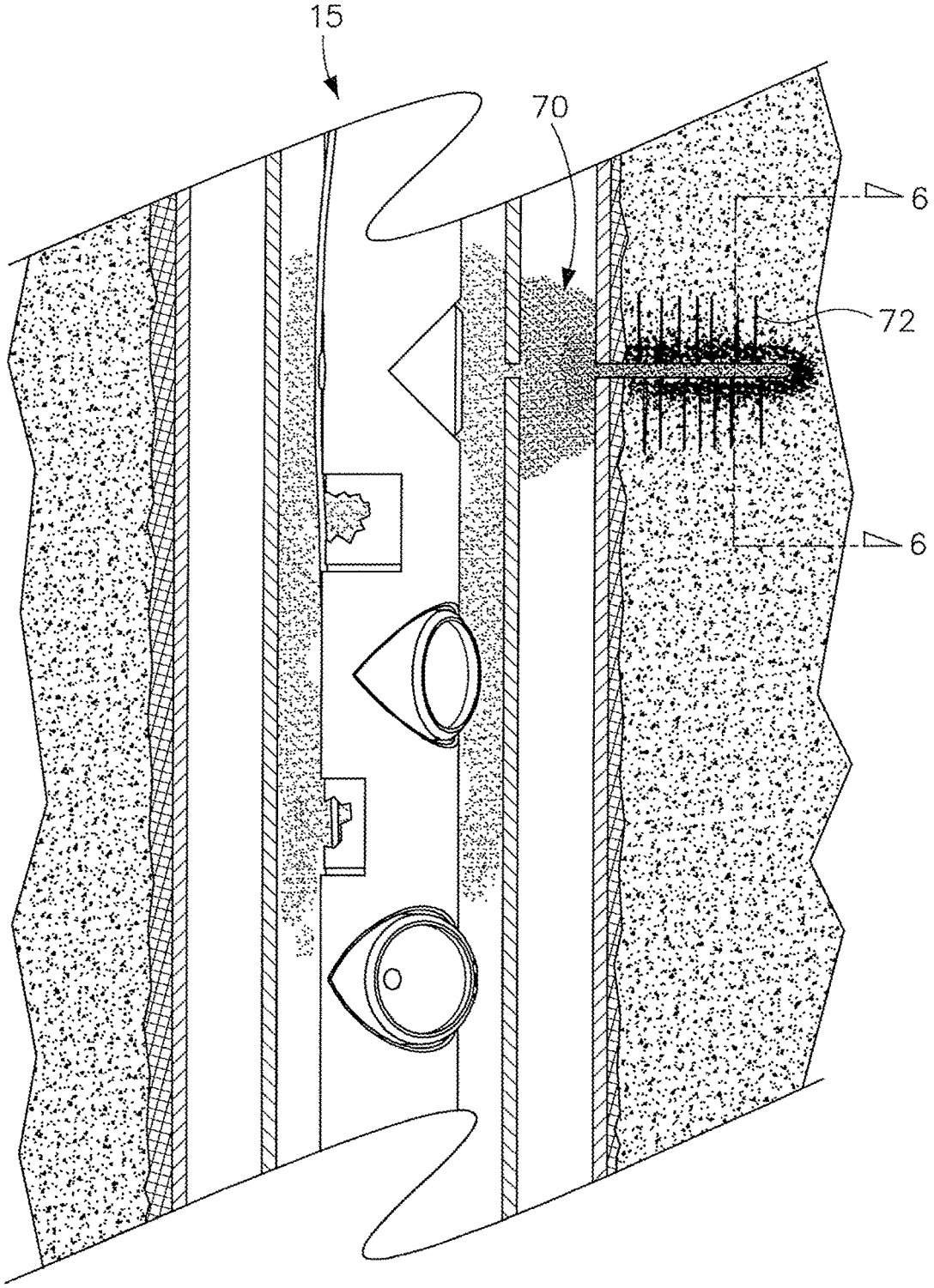
FIG. 5 shows the environment and device of FIG. 1, at a final stage of deployment, showing the finished perforation.
Figure 6:
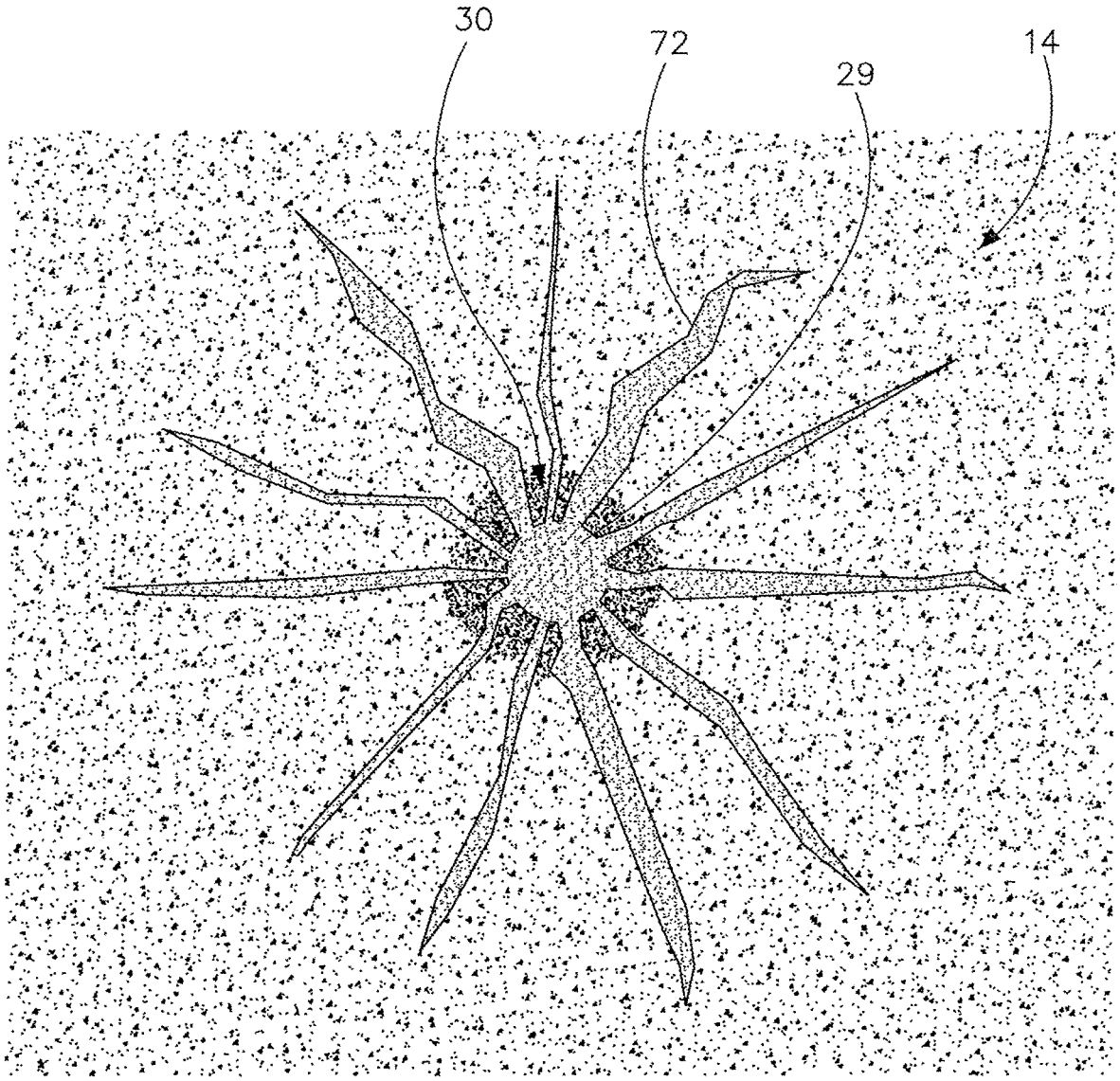
FIG. 6 is an expanded sectional detail view of the finished well wall perforation of FIG. 5, taken along line 6-6 of FIG. 5.

The filler material 90 may not only be used to help securely seat the propellant 38 within the container 20, but may also be used as a proppant that helps holds the fissures 72 (FIG. 6) in the surrounding rock 14 (FIGS. 1, 2, and 6) open and thereby enhance hydrocarbon recovery. More particularly, combustion of the propellant 38 may cause some or all of the filler material 90 to be aerosolized within the high-pressure gas 70 (FIGS. 3 and 5) generated during combustion. As the gas 70 is ejected from the carrier 24 (FIG. 1) via the carrier perforations 27 (FIGS. 3 and 4) and forced into the perforations 29 (FIGS. 3, 4, and 6) formed in the surrounding rock 14, the aerosolized filler material 90 may be entrained (suspended) in the gas 70 and injected into the fissures 72 emanating radially from perforations 29. Using the gas 70 as a carrier fluid, the filler material 90 may migrate (flow) deep into the fissures 72. Once the pressure within the rock 14 subsides, the filler material 90 may prop the fissures 72 open to enhance subsequent hydrocarbon recovery.

Figure 10:
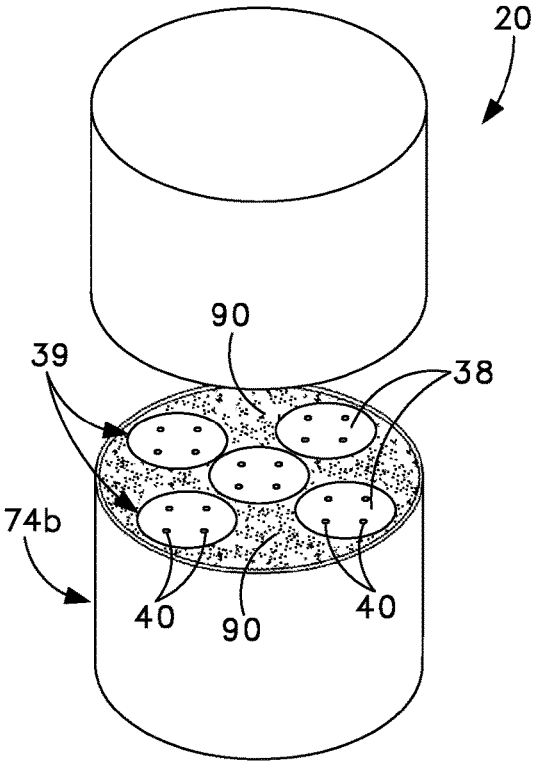
FIG. 10 is a schematic view of another embodiment of the container of FIG. 7, according to the principles of the present disclosure.

FIG. 10 is a schematic view of another embodiment of the container 20 according to the principles of the present disclosure. In the illustrated embodiment, only five pieces 39 of the propellant 38 are contained within the lower cap 74*b*. Moreover, each piece 39 of the propellant 38 defines or otherwise provides four through-holes 40, but could define more or less than four, without departing from the scope of the disclosure.

In contrast to the embodiments shown in FIGS. 7 and 9, none of the pieces 39 of propellant 38 in FIG. 10 touches an adjacent piece 39 or the sidewall of the lower cap 74*b*. Rather, a gap or space is defined between adjacent pieces 39 and between each piece 39 and the inner wall of the lower cap 74*b*. Consequently, the filler material 90 may be packed into the gaps and any other interstitial spaces defined between the adjacent pieces 39 and between each piece 39 and the inner wall of the lower cap 74*b*.

Filling the gaps and interstitial spaces with the filler material 90 may prove advantageous in selectively altering the deflagration rate of the propellant 38. More specifically, in some applications, only some (e.g., one) of the pieces 39 of propellant 38 may be ignited initially and combustion of this/these piece(s) 39 may cause the remaining adjacent pieces 39 to likewise combust. The filler material 90 may interfere with the flame propagation between adjacent pieces 39 and thereby help retard the overall burn rate of the container 20. More specifically, since the combustion flame is required to traverse the filler material 90 before igniting an adjacent piece 39 of propellant 38, the resulting burn rate of the container 20 is slowed, which may help keep the surrounding pressure from rising too rapidly. If the pressure rises too rapidly, it will build excessive pressure within the steel carrier 24 (FIG. 1), which could rupture the steel carrier 24 downhole and thereby get the steel carrier 24 stuck within the wellbore.

Figure 11:
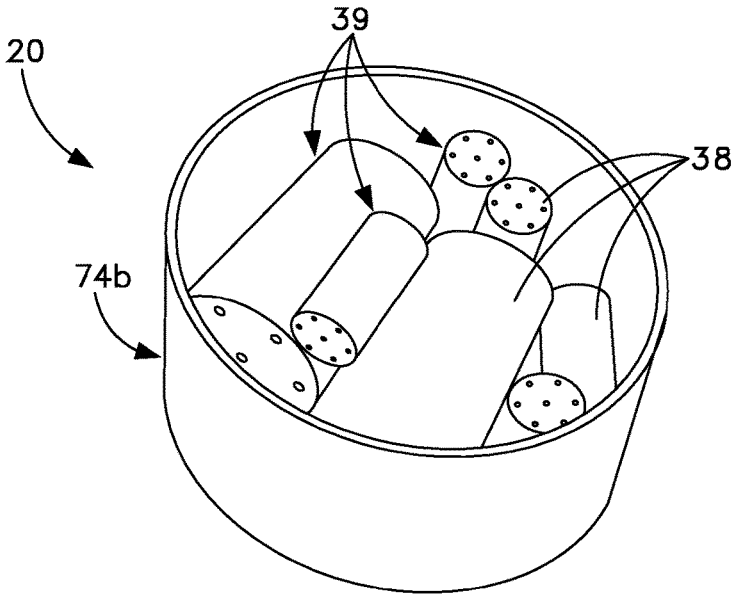
FIG. 11 is a schematic view of another embodiment of the container of FIG. 7, according to the principles of the present disclosure.

FIG. 11 is a schematic view of another embodiment of the container 20 according to the principles of the present disclosure. In the depicted embodiment, the upper cap 74*a* is omitted and a plurality of pieces 39 of propellant 38 are positioned within the lower cap 74*b*. Moreover, the filler material 90 (FIGS. 9-10) is also omitted, but may otherwise be packed around the pieces 39 within the lower cap 74*b*. As illustrated, the pieces 39 of propellant 38 do not all exhibit uniform dimensions and are otherwise non-uniform in dimensions. Rather, the pieces 39 can vary in size, length, diameter, etc. from other pieces 39 within the same container 20. Accordingly, it is contemplated herein that a dimension (e.g., size, length, diameter, etc.) of at least one of the pieces 39 may vary from other pieces 39 within the same container 20.

Moreover, the pieces 39 of propellant 38 may be arranged, positioned, or loaded within the lower cap 74*b* in a variety of positional configurations. In some embodiments, as shown in FIGS. 7, 9, and 10, the pieces 39 may each be uniformly positioned vertically within the lower cap 74*b*. In other embodiments, however, some or all of the pieces 39 may be positioned horizontally within the lower cap 74*b*. In yet other embodiments, as shown in FIG. 11, some pieces 39 may be arranged horizontally while others may be arranged vertically. In even further embodiments, the pieces 39 may simply be deposited randomly (non-uniformly) into the lower cap 74*b*, and some pieces 39 may lie atop other pieces 39 at an angle between vertical and horizontal, without departing from the scope of the disclosure. In such embodiments, the filler material 90 may again be packed into the interstitial spaces to secure the pieces 39 in place.

Figure 12A:
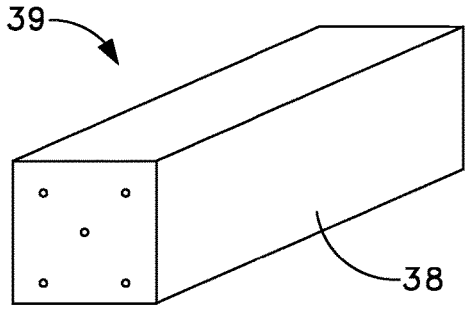
FIGS. 12A-12D depict isometric views of several example embodiments of pieces of propellant in accordance with the principles of the present disclosure.
Figure 12B:
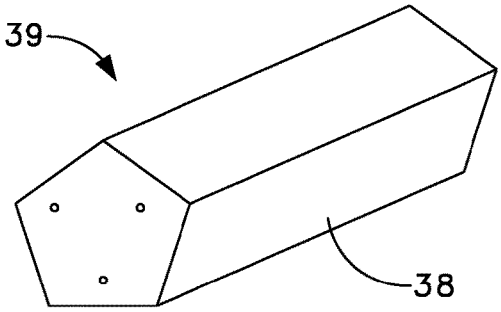
Figure 12C:
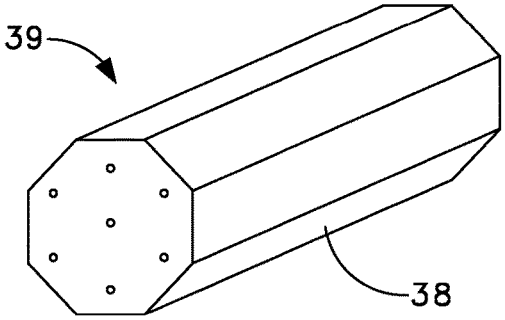
Figure 12D:
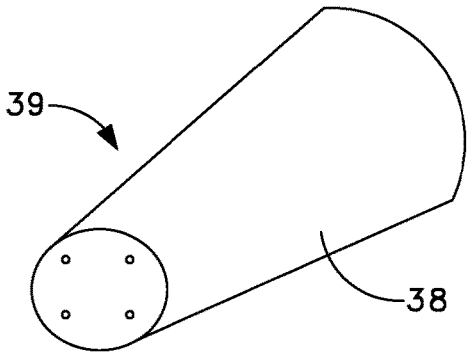

FIGS. 12A-12D are isometric views of several example embodiments of the pieces 39 of the propellant 38, in accordance with the principles of the present disclosure. As mentioned above, the pieces 39 of propellant 38 may exhibit varying cross-sectional shapes. In FIG. 12A, for example, the piece 39 exhibits a square cross-sectional shape; in FIG. 12B, the piece 39 exhibits a pentagonal cross-sectional shape; and in FIG. 12C, the piece 39 exhibits an octagonal cross-sectional shape. In FIG. 12D, the piece 39 exhibits a frustoconical or tapered shape where one end is larger than the opposing end. As will be appreciated, certain cross-sectional shapes allow the pieces 39 to be packaged and packed in a denser configuration within the container 20 (FIGS. 7 and 9-11). This can minimize the air space within the container 20, which maximizes the amount of energetic material and, thus, the energy content of the container 20.

Figure 13:
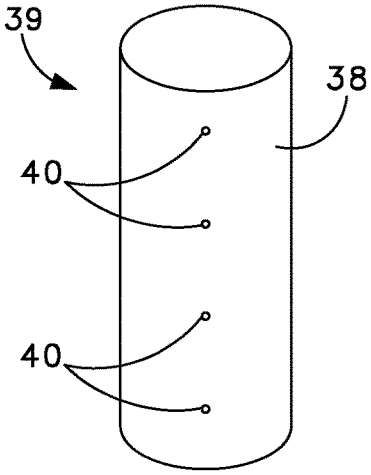
FIG. 13 depicts another example embodiment of a piece of the propellant in accordance with the principles of the present disclosure.

FIG. 13 depicts another example embodiment of the piece 39 of the propellant 38, in accordance with the principles of the present disclosure. In contrast to the embodiments discussed above where the through-holes 40 are defined longitudinally through the piece 39 and otherwise between opposing ends thereof, the through-holes 40 of the present embodiment may be defined laterally through a sidewall of the piece 39. In some embodiments, as illustrated, the through-holes 40 may be aligned vertically along the sidewall of the piece 39. In other embodiments, however, the through-holes 40 may not be aligned, without departing from the scope of the disclosure. In such embodiments, for example, vertically adjacent through-holes 40 may be 45° offset or 90° offset, or the through-holes 40 may be defined in a helical pattern extending about the sidewall of the piece 39.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A propellant container for a perforating gun, comprising:

a lower cap having an open end;

two or more pieces of propellant housed within the lower cap; and an upper cap matable with the lower cap at the open end via an interference fit, an adhesive, a wax, a threaded interface, or a combination thereof, wherein mating the lower cap and the upper cap secures the two or more pieces of propellant within the propellant container for use within the perforating gun, wherein a rate of combustion of at least one of the two or more pieces of propellant increases at a greater than linear rate and a surface area of the at least one of the two or more pieces of propellant increases during combustion until consumed by the combustion, and wherein at least one of the two or more pieces of propellant does not combust at an increasing rate after being ignited.

2. The propellant container of claim 1, wherein the upper and lower caps exhibit a cross-sectional shape selected from the group consisting of circular, polygonal, oval, ovoid, and any combination thereof.

3. The propellant container of claim 1, wherein the upper and lower caps are made of a material selected from the group consisting of cardboard, wood, paper, a polymer, a composite material, a metal, and any combination thereof.

4. The propellant container of claim 1, wherein the two or more pieces of propellant are cylindrical and exhibit a cross-sectional shape selected from the group consisting of circular, polygonal, frustoconical, and any combination thereof.

5. The propellant container of claim 1, further comprising a particulate filler material positioned within the lower cap.

6. The propellant container of claim 5, wherein the two or more pieces of propellant comprise at least two pieces of propellant separated by a gap filled with the filler material.

7. The propellant container of claim 1, wherein the one or more pieces of propellant comprise a plurality of pieces of propellant and the plurality of pieces of propellant exhibit non-uniform dimensions.

8. The propellant container of claim 1, wherein the one or more pieces of propellant comprise a plurality of pieces of propellant non-uniformly positioned within the lower cap.

9. The propellant container of claim 1, wherein at least two of the two or more pieces of propellant defines two or more through-holes.

10. The propellant container of claim 1, wherein a rate of combustion of each piece of propellant increases at a greater than linear rate and a surface area of each piece of propellant increases during combustion until consumed by the combustion.

11. A perforating gun, comprising:

a charge tube;

one or more shaped charges supported in the charge tube;

one or more containers supported in the charge tube, wherein each container comprises:

a lower cap having an open end;

two or more pieces of propellant housed within the lower cap; and an upper cap matable with the lower cap at the open end via an interference fit, an adhesive, a wax, a threaded interface, or a combination thereof; and a detonating cord extending to each shaped charge and each container to ignite the one or more shaped charges and the two or more pieces of propellant in each container, wherein a rate of combustion of at least one of the two or more pieces of propellant increases at a greater than linear rate and a surface area of the at least one of the two or more pieces of propellant increases during combustion until consumed by the combustion, wherein at least one of the two or more pieces of propellant does not combust at an increasing rate after being ignited, and wherein mating the lower cap and the upper cap secures the two or more pieces of propellant within the propellant container for use within the perforating gun.

12. The perforating gun of claim 11, further comprising a filler material positioned within the lower cap.

13. The perforating gun of claim 12, wherein the two or more pieces of propellant are separated by a gap filled with the filler material.

14. The propellant container of claim 1, wherein the upper cap is sized to receive an exterior surface of the lower cap at the open end to mate the upper cap to the lower cap.

* * * * *